US011178898B2

(12) United States Patent
Malgat et al.

(10) Patent No.: US 11,178,898 B2
(45) Date of Patent: Nov. 23, 2021

(54) HEATED AEROSOL GENERATING ARTICLE WITH THERMAL SPREADING ENDPIECE

(71) Applicant: Philip Morris Products S.A., Neuchatel (CH)

(72) Inventors: Alexandre Malgat, Les Tuileries de Grandson (CH); Stephane Roudier, Colombier (CH); Ana Carolina Borges De Couraca, Lausanne (CH); Frederic Lavanchy, Chavornay (CH); Cedric Meyer, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 252 days.

(21) Appl. No.: 15/101,026

(22) PCT Filed: Dec. 4, 2014

(86) PCT No.: PCT/EP2014/076652
§ 371 (c)(1),
(2) Date: Jun. 2, 2016

(87) PCT Pub. No.: WO2015/082654
PCT Pub. Date: Jun. 11, 2015

(65) Prior Publication Data

US 2016/0295916 A1 Oct. 13, 2016

(30) Foreign Application Priority Data

Dec. 5, 2013 (EP) ..... 13195907

(51) Int. Cl.
*A24F 47/00* (2020.01)
*A24B 3/14* (2006.01)
(Continued)

(52) U.S. Cl.
CPC ..... *A24B 3/14* (2013.01); *A24D 1/20* (2020.01); *A24F 40/46* (2020.01); *A24F 40/20* (2020.01)

(58) Field of Classification Search
CPC ..... A24F 47/008; A24F 47/004; A24F 40/20; A24D 1/20
See application file for complete search history.

(56) References Cited

U.S. PATENT DOCUMENTS 573,064 A * 12/1896 Vester ..... A24F 1/26 131/181
1,859,395 A * 5/1932 Hughes ..... A24F 13/08 131/363
(Continued)

FOREIGN PATENT DOCUMENTS

CH 691 156 A5 5/2001
CN 1289235 A 3/2001
(Continued)

OTHER PUBLICATIONS

International Search Report and Written Opinion of the International Searching Authority dated Mar. 5, 2015 in PCT/EP2014/076652 Filed Dec. 4, 2014.
(Continued)

*Primary Examiner* — Eric Yaary
(74) *Attorney, Agent, or Firm* — Oblon, McClelland, Maier & Neustadt, L.L.P.

(57) ABSTRACT

A heated aerosol-generating article for use with an aerosol-generating device is provided, in the form of a rod having a mouth end and a distal end upstream from the mouth end. An aerosol-forming substrate is located upstream of the mouth end within the rod and the distal end of the heated aerosol-
(Continued)

generating article is spanned by a non-flammable thermally-conductive material to reduce the propensity for ignition of the article.

9 Claims, 3 Drawing Sheets

(51) Int. Cl.

| | |
|---|---|
| ***A24D 1/20*** | (2020.01) |
| ***A24F 40/46*** | (2020.01) |
| *A24F 40/20* | (2020.01) |

(56) References Cited

U.S. PATENT DOCUMENTS

| | | | | | |
|---|---|---|---|---|---|
| 2,285,057 | A * | 6/1942 | Russell | A24F 1/06 | 131/194 |
| 2,580,974 | A * | 1/1952 | Sutter | A24F 5/00 | 131/184.2 |
| 3,409,019 | A * | 11/1968 | Chun | A24D 1/00 | 131/194 |
| 3,766,929 | A * | 10/1973 | Roman, Sr. | A24D 1/14 | 131/119 |
| 4,819,665 | A * | 4/1989 | Roberts | A24F 47/004 | 131/194 |
| 4,944,317 | A * | 7/1990 | Thal | A24D 1/14 | 131/348 |
| 5,019,122 | A * | 5/1991 | Clearman | A24F 47/004 | 131/194 |
| 5,095,921 | A | 3/1992 | Losee et al. | | |
| 9,532,603 | B2 * | 1/2017 | Plojoux | A24F 47/008 | |
| 2007/0102013 | A1 * | 5/2007 | Adams | A24F 47/008 | 131/273 |
| 2008/0053465 | A1 * | 3/2008 | Tarora | A24F 13/06 | 131/187 |
| 2008/0302374 | A1 * | 12/2008 | Wengert | A24F 47/004 | 131/178 |
| 2009/0151717 | A1 * | 6/2009 | Bowen | A61M 11/048 | 128/200.23 |
| 2010/0006113 | A1 * | 1/2010 | Urtsev | A24F 47/008 | 131/273 |
| 2010/0024834 | A1 * | 2/2010 | Oglesby | A24F 47/006 | 131/194 |
| 2010/0059070 | A1 * | 3/2010 | Potter | A24F 47/004 | 131/194 |
| 2012/0204889 | A1 * | 8/2012 | Xiu | A24F 47/008 | 131/273 |
| 2013/0014755 | A1 * | 1/2013 | Kumar | A24F 47/006 | 128/202.21 |
| 2013/0056013 | A1 * | 3/2013 | Terry | A24F 47/008 | 131/328 |
| 2014/0338686 | A1 | 11/2014 | Plojoux et al. | | |
| 2015/0053219 | A1 * | 2/2015 | Roudier | A24F 47/008 | 131/329 |
| 2015/0282525 | A1 * | 10/2015 | Plojoux | A24F 47/008 | 131/184.1 |
| 2015/0296882 | A1 * | 10/2015 | Mironov | A24C 5/54 | 131/330 |
| 2016/0100624 | A1 * | 4/2016 | Yilmaz | A24D 1/14 | 131/367 |
| 2018/0015237 | A1 * | 1/2018 | Thorens | A61M 11/003 | |
| 2018/0295881 | A1 * | 10/2018 | Mironov | A24F 47/008 | |
| 2018/0343920 | A1 * | 12/2018 | Sutton | A24F 47/008 | |

FOREIGN PATENT DOCUMENTS

| | | | | |
|---|---|---|---|---|
| CN | 2742785 | Y | * | 11/2005 |
| CN | 2742785 | Y | | 11/2005 |
| CN | 101568269 | A | | 10/2009 |
| CN | 101822420 | A | | 9/2010 |
| CN | 201919655 | U | | 8/2011 |
| EP | 0 277 519 | A2 | | 8/1988 |
| EP | 0 822 670 | A2 | | 2/1998 |
| EP | 2 084 978 | A1 | | 8/2009 |
| EP | 2 481 308 | A1 | | 8/2012 |
| EP | 2 609 821 | A1 | | 7/2013 |
| JP | 2013-519382 | A | | 5/2013 |
| RU | 2 328 192 | C1 | | 7/2008 |
| RU | 94 815 | U1 | | 6/2010 |
| WO | WO 99/44448 | A1 | | 9/1999 |
| WO | WO 2012/085205 | A1 | | 6/2012 |
| WO | WO 2013/083631 | A1 | | 6/2013 |
| WO | 2013/102609 | A2 | | 7/2013 |
| WO | WO 2013/098405 | A2 | | 7/2013 |
| WO | WO 2013/102614 | A2 | | 7/2013 |
| WO | WO 2013/120849 | A1 | | 8/2013 |

OTHER PUBLICATIONS

Office Action dated Oct. 9, 2018 in Japanese Patent Application No. 2016-532091, 14 pages (with English language translation).

Combined Office Action and Search Report dated Jun. 26, 2018 in Russian Patent Application No. 2016126555 (submitting English translation only), 7 pages.

Combined Chinese Office Action and Search Report dated Jul. 16, 2018 in Chinese Patent Application No. 201480063817.1 (submitting English translation only), 9 pages.

Indian Examination Report dated Jun. 4, 2020, in Patent Application No. 201617018912, 5 pages.

* cited by examiner

HEATED AEROSOL GENERATING ARTICLE WITH THERMAL SPREADING ENDPIECE

The present specification relates to heated aerosol-generating articles for use with an aerosol-generating device comprising a heating element, the articles having a lowered propensity for ignition, for example when brought into contact with a flame.

Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in conventional cigarettes. A conventional cigarette is lit when a user applies a flame to one end of the cigarette and draws air through the other end. The localised heat provided by the flame and the oxygen in the air drawn through the cigarette cause the end of the cigarette to ignite, and the resulting combustion generates an inhalable smoke. By contrast in heated aerosol-generating articles, an inhalable aerosol is typically generated by the transfer of heat from a heat source to a physically separate aerosol-forming substrate or material, which may be located within, around or downstream of the heat source. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Heated aerosol-generating articles comprising tobacco for generation of an aerosol by heating rather than burning are known in the art. For example, WO2013/102614 discloses an aerosol-generating system comprising a heated aerosol-generating article and an aerosol-generating device having a heater for heating the heated aerosol-generating article to produce an aerosol.

Tobacco used as part of an aerosol-forming substrate in heated aerosol-generating articles is designed to produce an aerosol when heated rather than when burned. Thus, such tobacco typically contains high levels of aerosol formers, such as glycerine or propylene glycol. If a user were to light a heated aerosol-generating article and smoke it as if it were a conventional cigarette that user would not receive the intended user experience. It would be desirable to produce a heated aerosol-generating article that has a lowered propensity for flame ignition. Such a heated aerosol-generating article would be preferably difficult to light during attempts to light the article with a lighter, such as a flame, in the manner of traditional cigarettes.

A heated aerosol-generating article may be provided in the form of a rod having a mouth end and a distal end upstream from the mouth end. The aerosol-generating article has an aerosol-forming substrate located upstream of the mouth end within the rod and the distal end of the heated aerosol-generating article is spanned by a non-flammable thermally-conductive material. The heated aerosol-generating article is for use with an aerosol-generating device comprising a heating element. If a heat source, such as a flame or other cigarette lighter, is applied to the distal end of the heated aerosol-generating article, the thermally-conductive material that spans the distal end of the aerosol-generating article conducts a portion of the heat away from the point of contact with the heat source. Thus, more thermal energy needs to be supplied in order to raise the temperature of the aerosol-forming substrate within the heated aerosol-generating article to its ignition point. This reduces the propensity for ignition of the aerosol-forming substrate.

Thus, the thermally-conductive material may act as a thermally-conducting flame barrier for preventing heat from being drawn into the aerosol-generating article and mitigating against the risk of a user inadvertently igniting the aerosol-forming substrate by applying a flame, or other ignition source, to the aerosol-generating article.

Preferably, the aerosol-generating article is a smoking article that generates an aerosol that is directly inhalable into a user's lungs through the user's mouth. More, preferably, the aerosol-generating article is a smoking article that generates a nicotine-containing aerosol that is directly inhalable into a user's lungs through the user's mouth.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

For the avoidance of doubt, the term 'heating element' is used to mean one or more heating elements.

The thermally-conductive material is a non-flammable material. The thermally-conductive material is preferably a metal foil, such as aluminium foil. The thermally-conductive material may comprise a metal foil, such as aluminium foil. For example, the thermally-conductive material may be a co-laminated sheet comprising aluminium foil and a second material such as paper.

Aluminium foil is a highly efficient thermal conductor either on its own or as a layer in a co-laminated sheet. The thermally-conductive material is not a carbonaceous material.

The heated aerosol-generating article may comprise a plurality of elements, including the aerosol-forming substrate, assembled within a wrapper, such as a cigarette paper, to form a rod. The thermally-conductive material is arranged to span the distal end of the rod and help prevent the influx of heat into the rod. The thermally-conductive material may also spread heat away from the distal end of the heated aerosol-generating device to lower the risk of igniting the aerosol-forming substrate.

The thermally-conductive material spans the distal end of the rod and may extend downstream along the rod to dissipate heat directly applied to the distal end of the rod, thereby reducing the propensity for ignition of the rod. For example the thermally-conductive material may extend by a distance of at least 5 mm downstream along the rod, preferably at least 10 mm downstream along the rod.

The heated aerosol-generating article may be in the form of a rod having a mouth end and a distal end upstream from the mouth end, in which a spacer element is located within the rod upstream of the aerosol-forming substrate. The spacer element may be in the form of a tube. The thermally-conductive material may be located by the spacer element. For example, the spacer element may be in the form of a tube and the thermally-conductive material may span an end of the tube.

The thermally-conductive material may span the distal end of the aerosol-generating article such that flow of air into the distal end of the article is prevented. Preferably, the thermally-conductive material is rupturable to enable air flow into the distal end.

In preferred embodiments of a heated aerosol-forming article, the aerosol-forming substrate may comprise a gathered sheet of aerosol-forming material circumscribed by a wrapper. The gathered sheet of aerosol-forming material may be a sheet of tobacco such as a sheet of homogenised tobacco.

The aerosol-forming substrate may be formed as a rod of cut filler, and the rod of cut filler may be encircled by a wrapper.

The heated aerosol-generating article is preferably for use with an aerosol-generating device that comprises an insertable heating element for insertion into a distal end of the heated aerosol-generating article. The heating element may be brought into contact with the aerosol-forming substrate within the aerosol-generating article by removing the thermally-conductive material or by piercing the thermally-conductive material. Prior to use, the thermally-conductive material provides some mitigation against ignition of the aerosol-forming substrate using an external ignition source such as a flame.

The aerosol-forming substrate may be in the form of a rod comprising aerosol-forming material. A rod may be provided comprising a gathered sheet of aerosol-forming material circumscribed by a wrapper. Such a rod may be assembled within a cigarette paper, or other suitable material, as an aerosol-forming substrate of an aerosol-generating article.

Preferably the sheet of aerosol-forming material comprises tobacco, for example tobacco that may be classed as homogenised, reconstituted or cast leaf tobacco.

The gathered sheet of material preferably extends along substantially the entire rod length of the rod and across substantially the entire transverse cross-sectional area of the rod.

Preferably, rods according to the specification are of substantially uniform cross-section.

Rods according to various aspects of the specification may be produced having different dimensions depending upon their intended use. The heated aerosol-generating article is in the form of a rod and the aerosol-forming substrate, which is a component part of the heated aerosol-generating article, may also be in the form of a rod.

Rods according to the specification may have a diameter of between about 5 mm and about 10 mm depending upon their intended use.

For example, rods according to the specification may have a rod length of between about 5 mm and about 150 mm depending upon their intended use.

In preferred embodiments, rods according to the specification for use as aerosol-forming substrates in heated aerosol-generating articles may have a rod length of between about 5 mm and about 20 mm or about 30 mm.

Rods according to the specification of a desired unit rod length may be produced by forming a rod of multiple unit rod length and then cutting or otherwise dividing the rod of multiple unit rod length into multiple rods of the desired unit rod length.

For example, rods having a rod length of about 15 mm for use as aerosol-forming substrates in heated aerosol-generating articles may be produced by forming a rod having a rod length of about 150 mm and then severing the elongate rod into ten rods having a rod length of about 15 mm.

As used herein, the term 'rod' is used to denote a generally cylindrical element of substantially circular, oval or elliptical cross-section.

As used herein, the term 'sheet' denotes a laminar element having a width and length substantially greater than the thickness thereof. The width of a sheet is greater than 10 mm, preferably greater than 20 mm or 30 mm.

As used herein, the term "co-laminated sheet" denotes a single sheet formed from two or more layers of material in intimate contact with one another.

As used herein, the term "aerosol-forming material" denotes a material that is capable of releasing volatile compounds upon heating to generate an aerosol. An aerosol-forming substrate may comprise or consist of an aerosol-forming material.

As used herein, the term 'rod length' denotes the dimension in the direction of the cylindrical axis of rods as described herein.

As used herein, the term 'homogenised tobacco material' denotes a material formed by agglomerating particulate tobacco.

As used herein, the term 'gathered' denotes that the sheet of tobacco material is convoluted, folded, or otherwise compressed or constricted substantially transversely to the cylindrical axis of the rod.

As used herein, the terms 'upstream' and 'downstream' are used to describe the relative positions of components, or portions of components, of aerosol-generating articles comprising rods as described herein in relation to the direction of air drawn through the aerosol-generating articles during use thereof.

The gathered sheet of aerosol-forming material may be a textured sheet of material. Use of a textured sheet of material may advantageously facilitate gathering of the sheet to form an aerosol-forming substrate as described herein.

As used herein, the term 'textured sheet' denotes a sheet that has been crimped, embossed, debossed, perforated or otherwise deformed. Textured sheets of material may comprise a plurality of spaced-apart indentations, protrusions, perforations or a combination thereof.

As used herein, the term 'crimped sheet' is intended to be synonymous with the term 'creped sheet' and denotes a sheet having a plurality of substantially parallel ridges or corrugations.

A number of aerosol-generating articles in which an aerosol-forming substrate is heated rather than combusted have been proposed in the art. Typically in heated aerosol-generating articles, an aerosol is generated by the transfer of heat from a heat source, for example a chemical, electrical or combustible heat source, to a physically separate aerosol-forming substrate, which may be located within, around or downstream of the heat source.

As used herein, the term 'aerosol-forming substrate' denotes a substrate consisting of or comprising an aerosol-forming material that is capable of releasing volatile compounds upon heating to generate an aerosol.

Rods used as aerosol-forming substrates in heated aerosol-generating articles are typically significantly shorter in rod length than rods of combustible smokable material in conventional lit-end smoking articles.

In preferred embodiments, the heated aerosol-generating articles described herein are for use in electrically-operated aerosol-generating systems in which the aerosol-generating substrate of the heated aerosol-generating article is heated by an electrical heat source. Such heated aerosol-generating articles are frequently constructed having an aerosol-forming substrate at a distal end. Thus, a user may inadvertently attempt to light the article in a traditional manner. The reduced ignition propensity of heated aerosol-generating articles in which the distal end of the aerosol-generating article is spanned by a thermally-conductive material may advantageously dissuade a user from attempting to ignite the article.

Heated aerosol-generating articles may be of the type disclosed in EP-A-0 822 670.

A system may be provided comprising an electrically-operated aerosol-generating apparatus and an aerosol-generating article for use with the apparatus. The aerosol-generating article is any heated aerosol-generating article as described herein.

Preferred embodiments of aerosol-generating articles comprise gathered sheets of homogenised tobacco material as the aerosol-forming substrate. In certain embodiments, sheets of homogenised tobacco material may have a tobacco content of at least about 40% by weight on a dry weight basis or of at least about 50% by weight on a dry weight basis. In other embodiments, sheets of homogenised tobacco material may have a tobacco content of about 70% or more by weight on a dry weight basis. The use of sheets of homogenised tobacco material having high tobacco content advantageously generates aerosols with enhanced tobacco flavour.

Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Homogenised tobacco material may comprise between about 1% and about 5% non-tobacco fibres by weight on a dry weight basis.

Suitable aerosol-formers and humectants for inclusion in sheets of homogenised tobacco material are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, sheets of homogenised tobacco material may have an aerosol former content of between about 5% and about 30% by weight on a dry weight basis. Heated aerosol-generating articles may preferably include homogenised tobacco having an aerosol former content of greater than 5% to about 30%. The aerosol former may preferably be glycerine.

Sheets of homogenised tobacco material for use in forming heated aerosol-generating articles as described herein are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

For example, in certain embodiments sheets of homogenised tobacco material may be formed from slurry comprising particulate tobacco, guar gum, cellulose fibres and glycerine by a casting process.

Sheets of homogenised tobacco material may be textured using suitable known machinery for texturing filter tow, paper and other materials.

For example, sheets of homogenised tobacco material may be crimped using a crimping unit of the type described in CH-A-691156, which comprises a pair of rotatable crimping rollers. However, it will be appreciated that sheets of homogenised tobacco material may be textured using other suitable machinery and processes that deform or perforate the sheets of homogenised tobacco material.

Preferably, sheets of tobacco material for use in forming aerosol-forming substrates of heated aerosol-generating articles have a width of at least about 25 mm. In certain embodiments sheets of material may have a width of between about 25 mm and about 300 mm. Preferably, the sheets of material have a thickness of at least about 50 μm to about 300 μm.

In certain embodiments, individual sheets of material may have a thickness of between 10 μm and about 250 μm. In certain embodiments, sheets of homogenised tobacco material may have a grammage 100 $g/m^2$ and about 300 $g/m^2$.

A method may be provided of forming an aerosol-forming substrate for a heated aerosol-generating article. The method may comprise the steps of: providing a continuous sheet comprising an aerosol-forming material; gathering the sheet transversely relative to the longitudinal axes thereof; circumscribing the gathered sheet with a wrapper to form a continuous rod, and severing the continuous rod into a plurality of discrete rods of aerosol-forming substrate. The aerosol-forming material may be any aerosol-forming material described above, and is preferably homogenised tobacco. In certain embodiments the wrapper is any suitable material such as a cigarette paper.

The method may further comprise texturing the continuous sheet. For example, the method may comprise crimping, embossing, perforating or otherwise texturing the continuous sheet prior to gathering.

Specific embodiments will be further described, by way of example only, with reference to the accompanying drawings in which.

Figure 1:
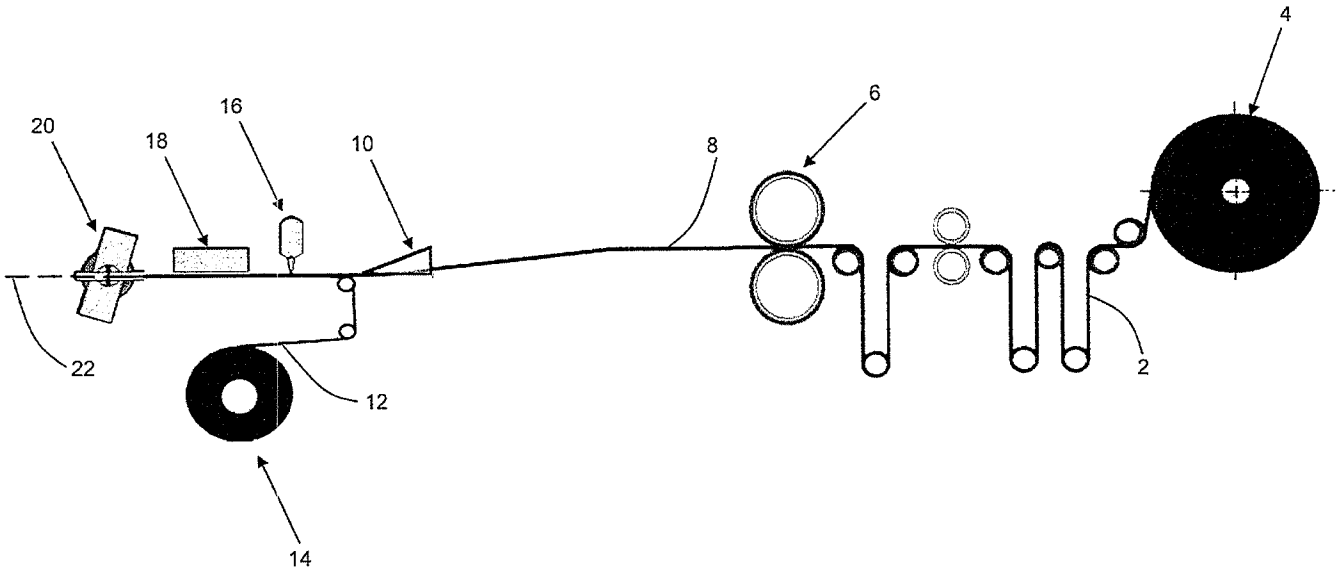
FIG. 1 shows a schematic cross-section of apparatus for forming a rod of aerosol-forming substrate for use in a heated aerosol-generating article.

The apparatus shown in FIG. 1 generally comprises: supply means for providing a continuous sheet of homogenised tobacco; crimping means for crimping the continuous sheet; rod forming means for gathering the continuous crimped sheet and circumscribing the gathered material with a wrapper to form a continuous rod; and cutting means for severing the continuous rod into a plurality of discrete rods. The apparatus also comprises transport means for transporting the continuous sheet of material downstream through the apparatus from the supply means to the rod forming means via the crimping means.

As shown in FIG. 1, the supply means for providing a continuous sheet comprises a continuous sheet of homogenised tobacco 2 mounted on a bobbin 4. The crimping means comprises a pair of rotatable crimping rollers 6. In use, the continuous sheet of homogenised tobacco 2 is drawn from the first bobbin 4 and transported downstream to the pair of crimping rollers 6 by the transport mechanism via a series of guide and tensioning rollers. As the continuous sheet of homogenised tobacco 2 is fed between the pair of crimping rollers 6, the crimping rollers engage and crimp the sheet 2 to form a continuous crimped sheet of homogenised tobacco 8 having a plurality of spaced-apart ridges or corrugations substantially parallel to the longitudinal axis of the sheet through the apparatus.

The continuous crimped sheet of homogenised tobacco material 8 is transported downstream from the pair of crimping rollers 6 towards the rod forming means and fed through a converging funnel or horn 10. The converging funnel 10 gathers the continuous sheet of homogenised tobacco 8 transversely relative to its longitudinal axes. The sheet of material 8 assumes a substantially cylindrical configuration as it passes through the converging funnel 10.

Upon exiting the converging funnel 10, the gathered sheet of homogenised tobacco is wrapped in a continuous sheet of cigarette paper 12. The continuous sheet of paper is fed from a bobbin 14 and enveloped around the gathered continuous crimped sheet of homogenised tobacco material by an endless belt conveyor or garniture. As shown in FIG. 1, the rod forming means comprises an adhesive application means 16 that applies adhesive to one of the longitudinal edges of the continuous sheet of paper, so that when the opposed longitudinal edges of the continuous sheet of paper are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete rods of unit rod length or multiple unit rod length.

Figure 2:
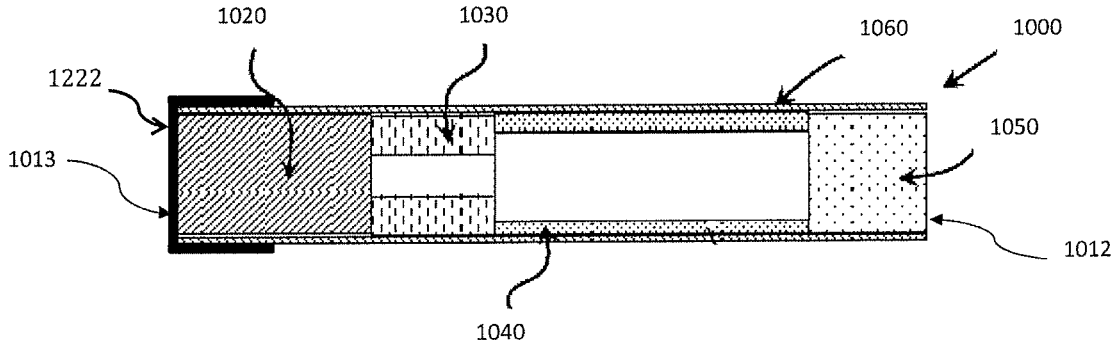
FIG. 2 illustrates an embodiment of an aerosol-generating article as described herein.

FIG. 2 illustrates an embodiment of a heated aerosol-generating article 1000 comprising a rod as described herein. The article 1000 comprises four elements; an aerosol-forming substrate 1020, a hollow cellulose acetate tube 1030, a spacer element 1040, and a mouthpiece filter 1050. These four elements are arranged sequentially and in coaxial alignment and are assembled by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 2 is particularly suitable for use with an electrically-operated aerosol-generating device comprising a heater for heating the aerosol-forming substrate.

When assembled, the article 1000 is about 45 millimetres in length and has an outer diameter of about 7.2 millimetres and an inner diameter of about 6.9 millimetres.

The aerosol-forming substrate 1020 comprises a rod formed from a crimped and gathered sheet of homogenised tobacco wrapped in paper to form a plug. A distal end of the heated aerosol generating article is spanned by an aluminium foil 1222 which extends around the distal end and downstream along the article for about 10 mm. A user may inadvertently attempt to ignite the aerosol-forming substrate 1020 by applying a flame to the distal end 1013 and simultaneously drawing air through the mouthpiece. Should this occur, the aluminium foil spanning the distal end of the aerosol-generating article will swiftly spread the applied heat, thereby making it more difficult to increase the homogenised tobacco component to its ignition temperature. Furthermore, the foil substantially prevents air from being drawn into the article, thereby restricting the oxygen available in the region of the aerosol-forming substrate for combustion. This lowered propensity for ignition and combustion may be sufficient for the user to desist in the attempts to ignite the article.

An aerosol-generating article 1000 as illustrated in FIG. 2 is designed to engage with an aerosol-generating device in order to be consumed. Such an aerosol-generating device includes means for heating the aerosol-forming substrate 1020 to a sufficient temperature to form an aerosol. Typically, the aerosol-generating device may comprise a heating element that surrounds the aerosol-generating article 1000 adjacent to the aerosol-forming substrate 1020, or a heating element that is inserted into the aerosol-forming substrate 1020.

Once engaged with an aerosol-generating device, a user draws on the mouth-end 1012 of the smoking article 1000 and the aerosol-forming substrate 1020 is heated to a temperature of about 375 degrees Celsius. At this temperature, volatile compounds are evolved from the sheet of cast-leaf tobacco of the aerosol-forming substrate 1020. These compounds condense to form an aerosol. The aerosol is drawn through the filter 1050 and into the user's mouth.

Figure 3:
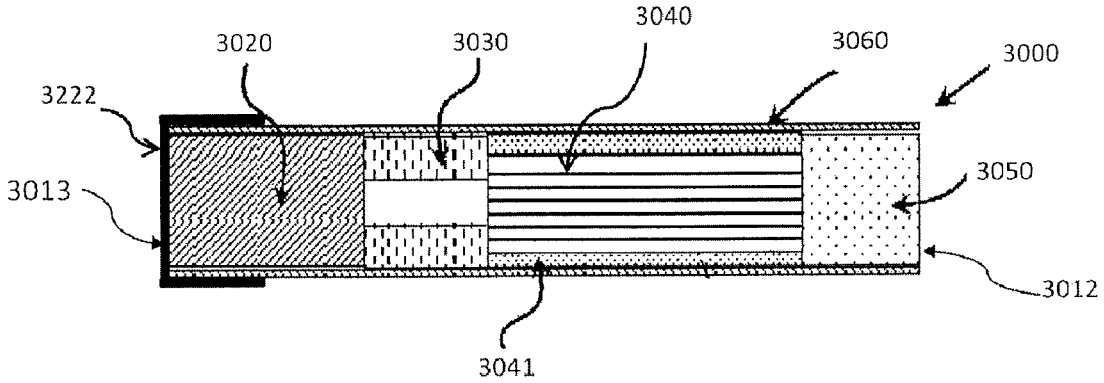
FIG. 3 illustrates an alternative embodiment of an aerosol-generating article as described herein.

FIG. 3 illustrates an alternative embodiment of a heated aerosol-generating article 3000 comprising a rod as described herein. The article 3000 comprises four elements; an aerosol-forming substrate 3020, a hollow cellulose acetate tube 3030, an aerosol-cooling element 3040, and a mouthpiece filter 3050. These four elements are arranged sequentially and in coaxial alignment and are assembled by a cigarette paper 3060 to form the aerosol-generating article 3000. The article 3000 has a mouth-end 3012, which a user inserts into his or her mouth during use, and a distal end 3013 located at the opposite end of the article to the mouth end 3012. The aerosol-cooling element 3040 acts as a spacer element as described in relation to FIG. 2 as well as an aerosol-cooling element. In use, volatile substances released from the aerosol-forming substrate 3020 pass along the aerosol-cooling element 3040 towards a mouth end 3012 of the aerosol-generating article 3000. The volatile substances may cool within the aerosol-cooling element 3040 to form an aerosol that is inhaled by the user. In the embodiment illustrated in FIG. 3, the aerosol-cooling element comprises a crimped and gathered sheet of polylactic acid circumscribed by a wrapper. As with the embodiment illustrated in FIG. 2, a distal end of the heated aerosol generating article is spanned by an aluminium foil 3222 which extends around the distal end and downstream along the article for about 10 mm.

Figure 4:
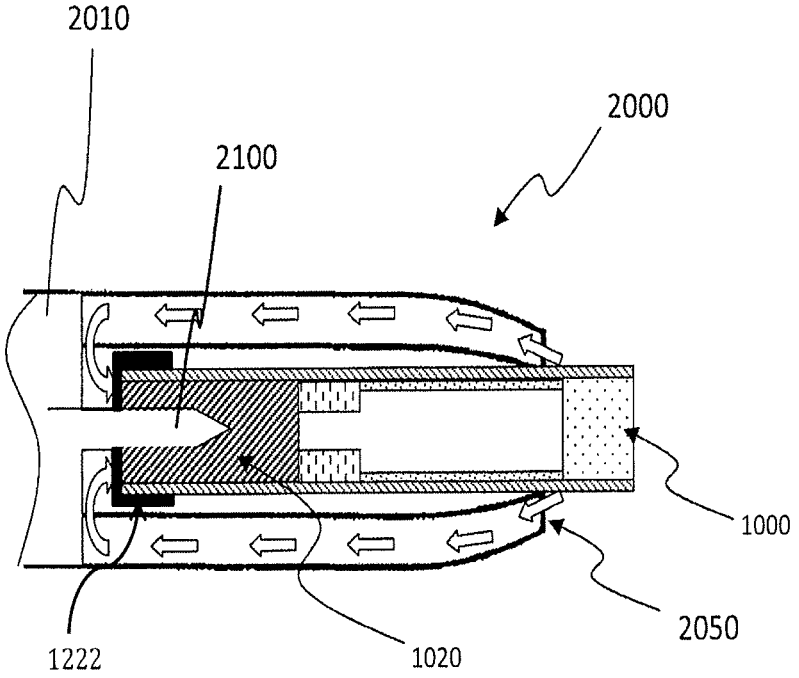
FIG. 4 illustrates an aerosol-generating system comprising an electrically-operated aerosol-generating device and an aerosol-generating article as illustrated in FIG. 2.
Figure 5:
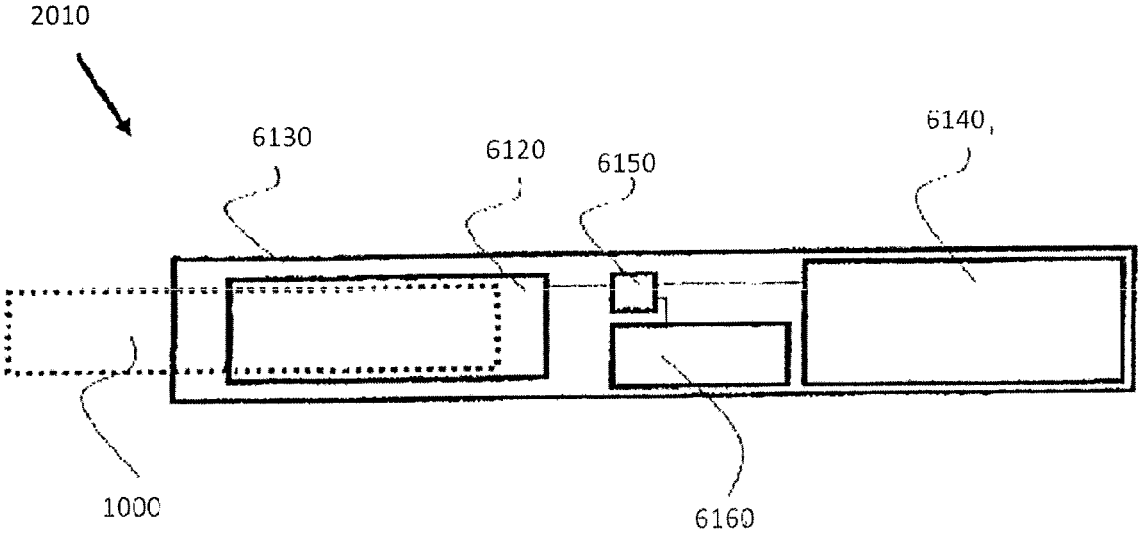
FIG. 5 is a schematic cross-sectional diagram of the aerosol-generating device illustrated in FIG. 4.

FIG. 4 illustrates a portion of an electrically-operated aerosol-generating system 2000 that utilises a heating blade 2100 to heat an aerosol-generating substrate 1020 of an aerosol-generating article 1000. The heating blade is mounted within an aerosol article receiving chamber of an electrically-operated aerosol-generating device 2010. The aerosol-generating device defines a plurality of air holes 2050 for allowing air to flow to the aerosol-generating article 1000. On engagement with the aerosol-generating device 2010 the aluminium foil 1222 spanning the distal end 1013 is pierced by the heating blade 2100. Thus, when the heating blade is actuated and a user draws on the mouth end of the aerosol-generating article, air is able to flow into the article and deliver an aerosol to the user through the mouth end. Air flow is indicated by arrows on FIG. 4. The aerosol-generating device comprises a power supply and electronics, which are illustrated in FIG. 5. The aerosol-generating article 1000 of FIG. 4 is as described in relation to FIG. 2.

In FIG. 5, the components of the aerosol-generating device 2010 are shown in a simplified manner. Particularly, the components of the aerosol-generating device 2010 are not drawn to scale in FIG. 4. Components that are not relevant for the understanding of the embodiment have been omitted to simplify FIG. 4.

As shown in FIG. 5, the aerosol-generating device 2010 comprises a housing 6130. The heating element 6120 is mounted within an aerosol-generating article receiving chamber within the housing 6130. The aerosol-generating article 1000 (shown by dashed lines in FIG. 5) is inserted into the aerosol-generating article receiving chamber within the housing 6130 of the aerosol-generating device 2010 such that the heating element 6120 is directly inserted into the aerosol-forming substrate 1020 of the aerosol-generating article 1000.

Within the housing 6130 there is an electrical energy supply 6140, for example a rechargeable lithium ion battery. A controller 6150 is connected to the heating element 6120, the electrical energy supply 6140, and a user interface 6160, for example a button or display. The controller 6150 controls the power supplied to the heating element 6120 in order to regulate its temperature.

The exemplary embodiments described above are not limiting. In view of the above-discussed exemplary embodiments, other embodiments consistent with the above exemplary embodiment will now be apparent to one of ordinary skill in the art.

The invention claimed is:

1. A heated aerosol-generating article for use with an aerosol-generating device comprising a heating element, the heated aerosol-generating article being in the form of a rod having a mouth end and a distal end upstream from the mouth end, the heated aerosol-generating article comprising a mouthpiece filter located at the mouth end, and an aerosol-forming substrate located upstream of the mouth end within the rod, wherein the distal end of the heated aerosol-generating article is spanned by a non-flammable thermally-conductive material configured to:

spread heat away from the distal end of the rod, prevent air flow into the distal end of the rod, and reduce a risk of inadvertent ignition of the rod when a flame is applied thereto, and wherein the non-flammable thermally-conductive material comprises a metal foil and is rupturable to enable air-flow into the distal end of the rod.

2. The heated aerosol-generating article according to claim 1, wherein the metal foil is aluminium foil.

3. The heated aerosol-generating article according to claim 1, wherein the non-flammable thermally-conductive material spans the distal end of the rod and extends downstream along the rod to dissipate heat directly applied to the distal end of the rod.

4. The heated aerosol-generating article according to claim 3, wherein the non-flammable thermally-conductive material extends downstream along the rod by at least 10 mm.

5. A heated aerosol-generating system, comprising:

a heated aerosol-generating article for use with an aerosol-generating device, the heated aerosol-generating article being in the form of a rod having a mouth end and a distal end upstream from the mouth end, the aerosol-generating article comprising a mouthpiece filter located at the mouth end, and an aerosol-forming substrate located upstream of the mouth end within the rod, in which a distal end of the heated aerosol-generating article is spanned by a non-flammable the material comprising a metal foil and being configured to spread heat away from the distal end of the rod and to prevent airflow into the distal end of the rod, such that a risk of inadvertent ignition of the rod by application of a flame is reduced, and the aerosol-generating device comprising a heating element, and a rupturing element configured to rupture the non-flammable thermally-conductive material spanning the distal end of the heated aerosol-generating article to allow air to be drawn through the aerosol-generating article when a user draws on the mouth end of the rod.

6. The heated aerosol-generating system according to claim 5, wherein the rupturing element is the heating element arranged to be inserted into the distal end of the heated aerosol-generating article when the heated aerosol-generating article is engaged with the aerosol-generating device to rupture the non-flammable thermally-conductive material and heat the aerosol-forming substrate to form an aerosol.

7. A method of smoking a heated aerosol-generating article as defined in claim 1, the method comprising:

coupling the distal end of the rod with the aerosol-generating device comprising the heating element;

rupturing the non-flammable thermally-conductive material spanning the distal end of the rod;

actuating the heating element to heat the aerosol-forming substrate and to generate an aerosol; and inhaling the aerosol through the mouth end of the rod.

8. The method according to claim 7, wherein the coupling the distal end of the rod with the aerosol-generating device causes the rupturing element to penetrate the distal end of the rod and to rupture the non-flammable thermally-conductive material.

9. The method according to claim 8, wherein the rupturing element is the heating element of the aerosol-generating device.

* * * * *